US010763608B1

(12) United States Patent
Wang et al.

(10) Patent No.: US 10,763,608 B1
(45) Date of Patent: Sep. 1, 2020

(54) ORTHOGONAL FEMALE CONNECTOR

(71) Applicant: AMPHENOL EAST ASIA ELECTRONIC TECHNOLOGY (SHEN ZHEN) CO., LTD., Shen Zhen, Guangdong Province (CN)

(72) Inventors: Xiang Wang, Shen Zhen (CN); Lei Liao, Shen Zhen (CN); Yan-Bin Tan, Shen Zhen (CN)

(73) Assignee: AMPHENOL EAST ASIA ELECTRONIC TECHNOLOGY (SHEN ZHEN) CO., LTD., Shen Zhen, Guangdong Province (CN)

( * ) Notice: Subject to any disclaimer, the term of this patent is extended or adjusted under 35 U.S.C. 154(b) by 0 days.

(21) Appl. No.: 16/502,876

(22) Filed: Jul. 3, 2019

(51) Int. Cl.

| | |
|---|---|
| ***H01R 13/10*** | (2006.01) |
| ***H01R 12/71*** | (2011.01) |
| ***H01R 24/86*** | (2011.01) |
| ***H01R 13/04*** | (2006.01) |
| *H01R 107/00* | (2006.01) |

(52) U.S. Cl.
CPC ..... *H01R 13/10* (2013.01); *H01R 12/716* (2013.01); *H01R 13/04* (2013.01); *H01R 24/86* (2013.01); *H01R 2107/00* (2013.01)

(58) Field of Classification Search
CPC ..... H01R 13/10; H01R 13/04; H01R 12/716; H01R 24/86; H01R 2107/00
See application file for complete search history.

(56) References Cited

U.S. PATENT DOCUMENTS

| | | | | |
|---|---|---|---|---|
| 9,077,118 | B2 * | 7/2015 | Szu | H01R 24/00 |
| 9,559,453 | B1 * | 1/2017 | Luo | H01R 12/57 |
| 9,564,714 | B1 * | 2/2017 | Wang | H01R 13/6461 |
| 9,941,641 | B1 * | 4/2018 | Jiang | H01R 13/6585 |
| 9,985,391 | B1 * | 5/2018 | Wang | H01R 12/724 |
| 10,283,910 | B1 * | 5/2019 | Chen | H01R 4/04 |
| 10,411,376 | B1 * | 9/2019 | Wang | H01R 13/6471 |
| 2012/0077389 | A1 * | 3/2012 | Zhang | H01R 24/60 439/660 |
| 2016/0013596 | A1 * | 1/2016 | Regnier | H01R 13/6594 439/607.35 |
| 2019/0097335 | A1 * | 3/2019 | Kee Mew | H01R 12/716 |

* cited by examiner

*Primary Examiner* — Abdullah A Riyami
*Assistant Examiner* — Nader J Alhawamdeh
(74) *Attorney, Agent, or Firm* — Muncy, Geissler, Olds & Lowe, P.C.

(57) ABSTRACT

An orthogonal female connector includes a plurality of terminal components, a main body, and a shell; the terminal components inserted in the main body and including a 40-pin, a 15-pin, a 7-pin, and a 6-pin terminal members; the terminal components having a board end and a plug end; the board end formed on a lower portion of the terminal component and combined on a printed circuit board; the plug end formed on an anterior portion of the terminal component and connected with a solid state disk interface; an angle included by pins of the board end and the plug end being 90 degrees; such that the 40-pin, 15-pin, 7-pin, and 6-pin terminal members are applied to be connected with a PSAS male connector; and the 15-pin and 7-pin terminal members are corporately applied to be connected with a SAS male connector, simplifying the structure and lowering cost.

5 Claims, 3 Drawing Sheets

ORTHOGONAL FEMALE CONNECTOR

BACKGROUND OF THE INVENTION

1. Field of the Invention

The present invention relates to connectors, and more particularly, to an orthogonal female connector.

2. Description of the Related Art

In the server application nowadays, a conventional vertical SAS or PSAS connector is usually formed of a female head combined with an intermediate plate and a back plate connector (male and female), and such combination is structurally complicated, with a higher production cost and disadvantages such as poor heat dissipation ability.

SUMMARY OF THE INVENTION

For improving the issues above, an orthogonal female connector is disclosed. With an optimized structural design, the connector structure is simple, lowering the production cost and enhancing the heat dissipation ability thereof.

For achieving the aforementioned objectives, an orthogonal female connector is provided, comprising: a plurality of terminal components, a main body, and a shell;

the terminal components being inserted in the main body and including a 40-pin terminal member, a 15-pin terminal member, a 7-pin terminal member, and a 6-pin terminal member;

each of the terminal components having a board end and a plug end;

the board end being formed on a lower portion of the terminal component to be combined on a printed circuit board;

the plug end being formed on an anterior portion of the terminal component to be connected with a solid state disk interface;

an angle included by pins of the board end and pins of the plug end being 90 degrees;

such that, the 40-pin terminal member, the 15-pin terminal member, the 7-pin terminal member, and the 6-pin terminal member are corporately applied to be connected with a PSAS male connector; the 15-pin terminal member and the 7-pin terminal member are corporately applied to be connected with a SAS male connector.

Preferably, the 40-pin terminal member of the orthogonal female connector includes a first terminal member part and a second terminal member part, wherein the first terminal member part is an 18-pin terminal member, and the second terminal member part is a 22-pin terminal member;

such that when a terminal seat plate of the first terminal member part and a terminal seat plate of the second terminal member part are overlapped, pins of the first terminal member part and pins of the second terminal member part form a total of forty pins that are arranged in a linear alignment for being inserted in a row of sockets on the main body.

Preferably, when the terminal seat plate of the first terminal member part and the terminal seat plate of the second terminal member part are overlapped, a combination of the terminal seat plates has a thickness of twenty-four millimeters.

Preferably, at least two orthogonal connectors are able to be inserted on the PCB (printed circuit board) simultaneously, and the plug end of the orthogonal female connector is plugged with the solid state disk interface.

Preferably, the main body is formed of an insulation plastic material; the shell is formed of a metal material and mounted on a rear end of the terminal components.

Preferably, the main body includes two engagement points disposed on two sides of the main body; the shell including two engagement slots disposed on two sides of the shell; when the main body and the shell are combined, the engagement points are correspondingly engaged in the engagement slots.

Therefore, with the optimized structure, the present invention improves the structural complexity, high production cost and poor heat dissipation of the conventional orthogonal connector. The present invention achieves following advantages. The orthogonal female connector comprises various terminal members, including the 40-pin terminal member, the 15-pin terminal member, the 7-pin terminal member, and the 6-pin terminal member. With different combinations of the terminal members, the present invention is allowed to be connected with PSAS or SAS male connectors. Also, the 40-pin terminal member is formed of the first terminal member part (18-pin) and the second terminal member part (22-pin), which are alternately inserted in the main body, such that the depth requirement for installing the product is reduced to 24 millimeters, thus favorable for saving the space requirement. Further, the board ends of the two or more orthogonal female connectors are allowed to be disposed on the PCB simultaneously, with the plug ends thereof being combined with the solid state disk interface.

DETAILED DESCRIPTION OF THE INVENTION

The aforementioned and further advantages and features of the present invention will be understood by reference to the description of the preferred embodiment in conjunction with the accompanying drawings where the components are illustrated based on a proportion for explanation but not subject to the actual component proportion.

Embodiment 1

Figure 1:
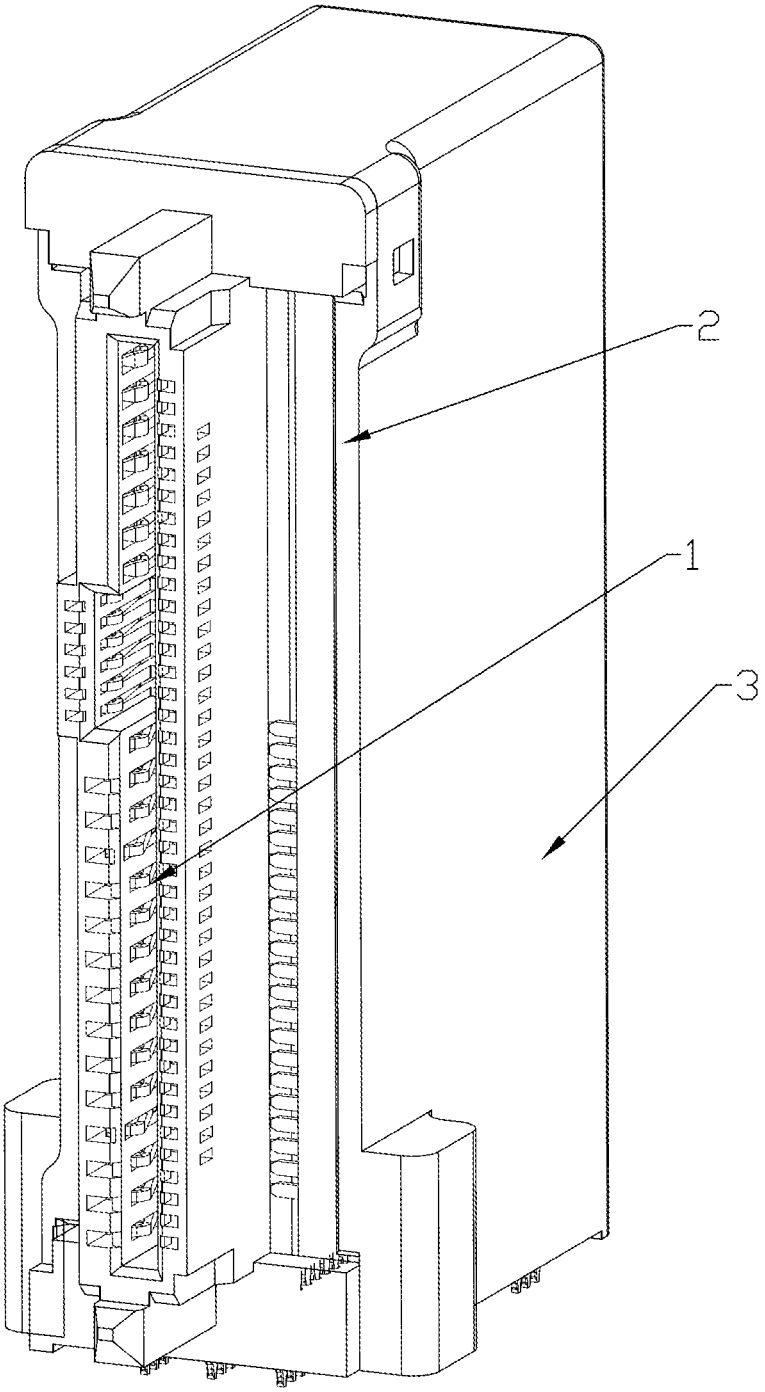
FIG. 1 is a perspective view of the orthogonal female connector in accordance with an embodiment of the present invention.
Figure 2:
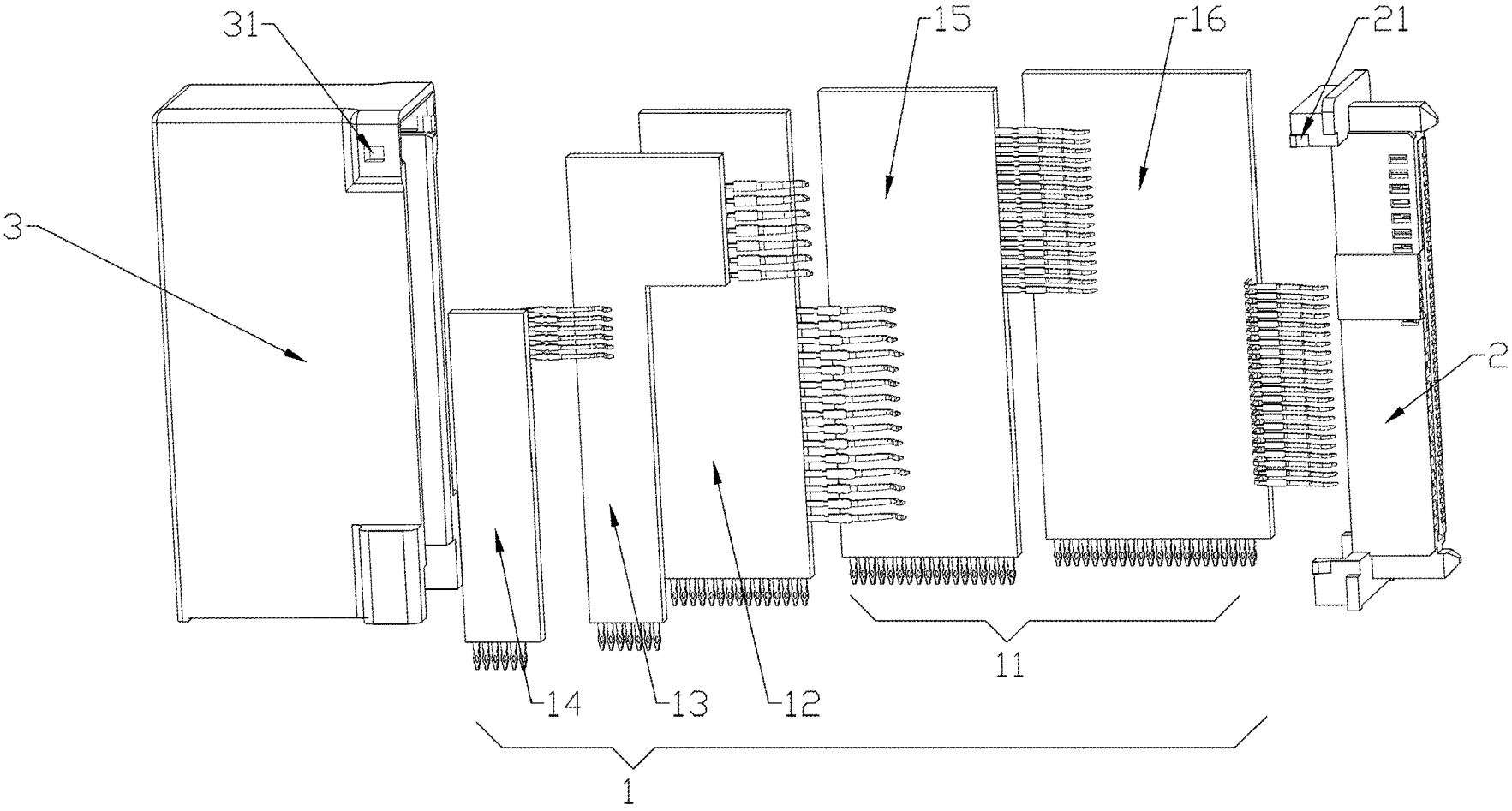
FIG. 2 is an exploded view of the orthogonal female connector in accordance with an embodiment of the present invention.

Referring to FIG. 1 and FIG. 2, an orthogonal female connector is provided, comprising terminal components 1, a main body 2, and a shell 3.

The terminal components 1 are inserted in the main body 2 and include a 40-pin terminal member 11, a 15-pin terminal member 12, a 7-pin terminal member 13, and a 6-pin terminal member 14.

Each of the terminal components has a board end and a plug end; with the board end being formed on a lower portion of the terminal component 1 to be combined on a PCB (printed circuit board) 4. The plug end is formed on an anterior portion of the corresponding terminal component 1 to be connected with a solid state disk 5 interface. An angle included by pins of the board end and pins of the plug end is 90 degrees.

The 40-pin terminal member 11, the 15-pin terminal member 12, the 7-pin terminal member 13, and the 6-pin terminal member 14 are corporately applied to be connected with a PSAS male connector.

The 15-pin terminal member 12 and the 7-pin terminal member 13 are corporately applied to be connected with a SAS male connector.

The main body 2 is formed of an insulation plastic material. The shell 3 is formed of a metal material and mounted on a rear end of the terminal components.

The 40-pin terminal member 11 of the orthogonal female connector includes a first terminal member part 15 and a second terminal member part 16, wherein the first terminal member part 15 is an 18-pin terminal member, and the second terminal member part 16 is a 22-pin terminal member.

When a terminal seat plate of the first terminal member part 15 and a terminal seat plate of the second terminal member part 16 are overlapped, pins of the first terminal member part 15 and pins of the second terminal member part 16 form a total of forty pins that are arranged in a linear alignment for being inserted in a row of sockets on the main body 2.

When the terminal seat plate of the first terminal member part 15 and the terminal seat plate of the second terminal member part 16 are overlapped, the combination thereby formed of the terminal seat plates has a thickness of twenty-four millimeters.

Embodiment 2

Figure 3:
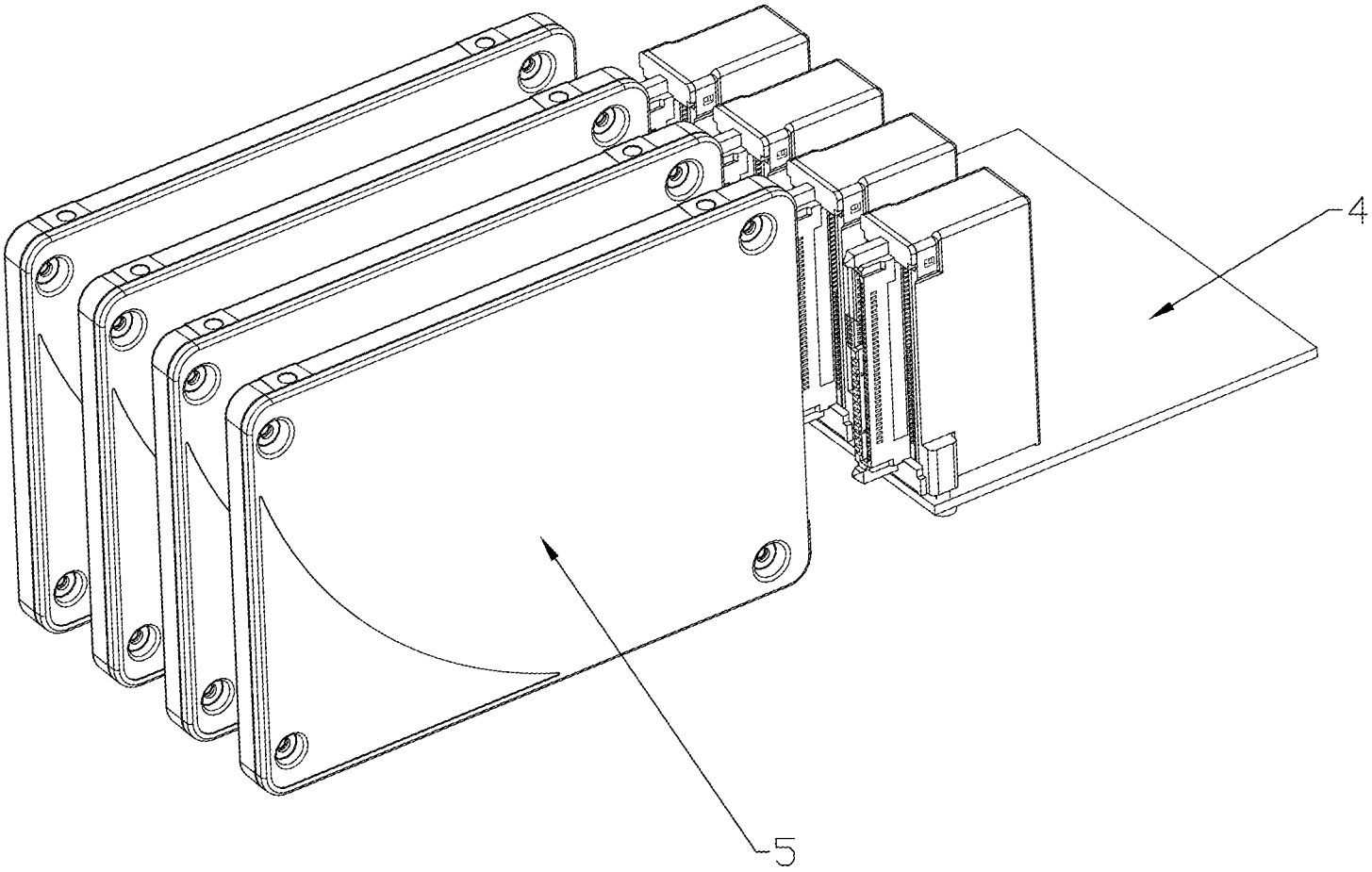
FIG. 3 is a schematic view illustrating the assembled status of the orthogonal female connector.

Based on the embodiment 1, referring to FIG. 3, two or more orthogonal female connector are allowed to be combined on the PCB 4 simultaneously, with the plug ends being plugged with the solid state disk 5 interface.

Embodiment 3

Based on the aforementioned embodiments, referring to FIG. 2, the main body 2 includes engagement points 21 disposed on two sides of the main body 2, and the shell 3 includes engagement slots 31 disposed on two sides of the shell 3. When the main body 2 is combined with the shell 3, the engagement points 21 are correspondingly engaged in the engagement slots 31.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An orthogonal female connector is provided, comprising:

a plurality of terminal components, a main body, and a shell;

the terminal components being inserted in the main body and including a 40-pin terminal member, a 15-pin terminal member, a 7-pin terminal member, and a 6-pin terminal member; each of the terminal components having a board end and a plug end; the board end being formed on a lower portion of the terminal component to be combined on a printed circuit board; the plug end being formed on an anterior portion of the terminal component to be connected with a solid state disk interface; an angle included by pins of the board end and pins of the plug end being 90 degrees;

the main body comprising two engagement points disposed on two sides of the main body;

the shell comprising two engagement slots disposed on two sides of the shell;

such that, the 40-pin terminal member, the 15-pin terminal member, the 7-pin terminal member, and the 6-pin terminal member are corporately applied to be connected with a PSAS male connector; and the 15-pin terminal member and the 7-pin terminal member are corporately applied to be connected with a SAS male connector; and when the main body and the shell are combined, the engagement points are correspondingly engaged in the engagement slots.

2. The orthogonal female connector of claim 1, wherein the 40-pin terminal member includes a first terminal member part and a second terminal member part; the first terminal member part is an 18-pin terminal member, and the second terminal member part is a 22-pin terminal member; when a terminal seat plate of the first terminal member part and a terminal seat plate of the second terminal member part are overlapped, pins of the first terminal member part and pins of the second terminal member part form a total of forty pins that are arranged in a linear alignment.

3. The orthogonal female connector of claim 1, wherein when the terminal seat plate of the first terminal member part and the terminal seat plate of the second terminal member part are overlapped, a combination of the two terminal seat plates has a thickness of twenty-four millimeters.

4. The orthogonal female connector of claim 1, wherein when at least two orthogonal female connectors are combined on the printed circuit board simultaneously, the plug ends of the orthogonal female connectors are plugged with a solid state disk interface, respectively.

5. The orthogonal female connector of claim 1, wherein the main body is formed of an insulation plastic material; the shell is formed of a metal material and mounted on a rear end of the terminal components.

* * * * *